US007306225B2

(12) United States Patent
Lu

(10) Patent No.: US 7,306,225 B2
(45) Date of Patent: Dec. 11, 2007

(54) OCTAVE MAGIC CUBE

(76) Inventor: Yi Lu, 83 Mondeo Drive, Unit 216, Toronto, Ontario (CA) M1P 5B6

( * ) Notice: Subject to any disclaimer, the term of this patent is extended or adjusted under 35 U.S.C. 154(b) by 9 days.

(21) Appl. No.: 11/433,885

(22) Filed: May 15, 2006

(65) Prior Publication Data

US 2007/0262522 A1 Nov. 15, 2007

(51) Int. Cl.
*A63F 9/08* (2006.01)

(52) U.S. Cl. ..... 273/153 S

(58) Field of Classification Search ..... 273/153 S, 273/153 R, 156

See application file for complete search history.

(56) References Cited

U.S. PATENT DOCUMENTS 4,344,623 A * 8/1982 Isobe ..... 273/153 S
4,378,117 A * 3/1983 Rubik ..... 273/153 S
4,405,131 A * 9/1983 Horvath ..... 273/153 S
4,540,177 A * 9/1985 Horvath ..... 273/153 S
4,557,484 A * 12/1985 Sherman et al. ..... 273/153 S
4,593,907 A * 6/1986 Abu-Shumays et al. . 273/153 S
5,826,871 A * 10/1998 Li ..... 273/153 S
2007/0057455 A1* 3/2007 Verdes ..... 273/153 S

FOREIGN PATENT DOCUMENTS

DE 3111381 A * 10/1982
GB 2092454 A * 8/1982

* cited by examiner

*Primary Examiner*—Steven Wong
(74) *Attorney, Agent, or Firm*—David W. Wong

(57) ABSTRACT

An octave magic cube has a spherical center core with square slider plates mounted at end of a six-arm cross center piece. A pattern of space channel is formed between the slider plates. Seven movable cubic block pieces having a triangular retainer plate mounted at the center of a partial spherical depression formed in one of its corners. The movable cubic block pieces are mounted to the core by slidably engaging the retainer plate with the space channel of the core. An eighth cubic block piece has a mounting plate with a clover leaf pattern is snap-mounted to the space channel of the core at the remaining position of the cube after the seven movable cubic block pieces have been mounted to the core.

4 Claims, 4 Drawing Sheets

OCTAVE MAGIC CUBE

BACKGROUND OF THE INVENTION

1. Field of the Invention

This invention relates to a six-sided cube consisting of eight blocks with graphic or pictorial designs provided on their three outside surfaces such that a player may manipulate the blocks to move relative to one another to obtain various design combinations for enjoyment and/or educational purposes.

2. Background Art

Heretofore, block games commonly consist of a plurality of block pieces movably mounted to a central core which may be a spherical ball having a plurality of arms radially extending outwards from its spherical surface. Slider plates are mounted at the end of the arms. The block pieces have a curved inner surface such that when they are placed side by side to one another to form a cube shaped overall block having a spherical space formed within it by the combination of the inner curved surface of the block pieces. Retainer plates are mounted on the curved surface of the block pieces such that the block pieces may be movably mounted to the core by slidably engaging the slider plates with the retainer plates. U.S. Pat. No. 4,344,623 to T. Isobe, U.S. Pat. No. 4,540,177 to T. Horvath and U.S. Pat. No. 4,378,117 to E. Rubik show such block games. However, these known block games are complicated in construction and they are problematic. As shown in the Rubik U.S. Pat. No. 4,378,117, springs must be provided in the radial arms of the core in order to pull the block pieces towards one another so that they may be held closely together. However, due to the spring arm construction, it is very difficult to mount the block pieces to the core. Furthermore, it is extremely difficult to mount the last block piece to the core.

SUMMARY OF THE INVENTION

It is a principal object of the present invention to provide an octave cube in which the movable block pieces are mounted to the core without using spring.

It is another object of the present invention to provide an octave cube consisting of seven block pieces movably mounted to the core and one block piece fixedly mounted to the core.

It is another object of the present invention to provide an octave cube in which the last block piece is easily mounted thereto.

Other objects and advantages of the present invention will be made apparent from the consideration of the following description, when taken in conjunction with the accompanying drawings.

BRIEF DESCRIPTION OF THE INVENTION

DETAILED DESCRIPTION OF THE PREFERRED EMBODIMENT

Figure 1:
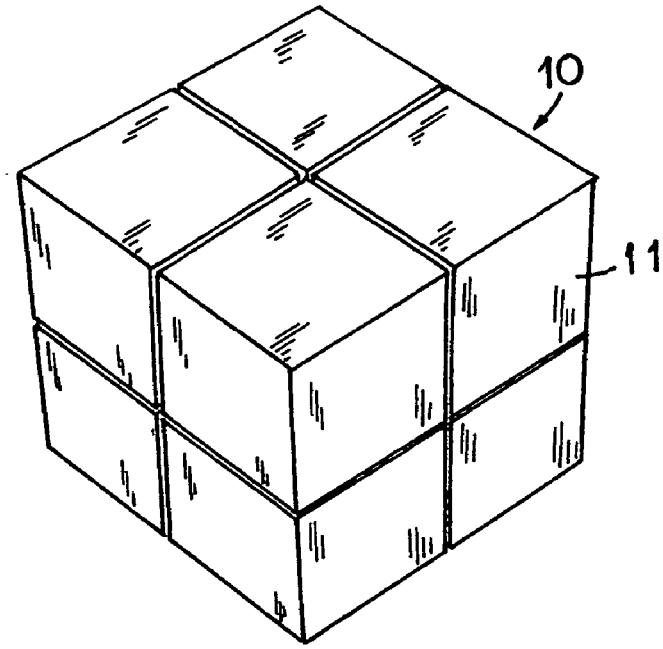
FIG. 1 is a perspective front elevation view of the octave cube according to the present invention.
Figure 2:
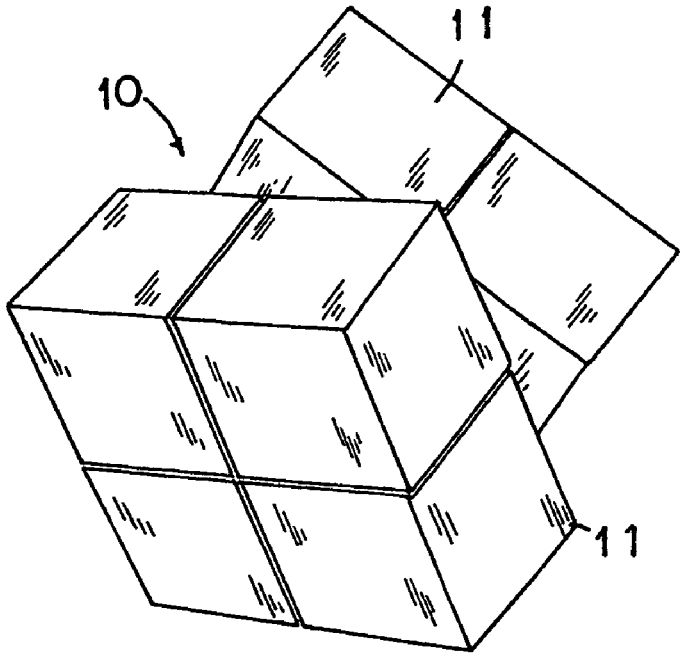
FIG. 2 is a perspective front elevation view of the octave cube showing the movement of the group of four block pieces relative to the neighboring group of four block pieces.
Figure 3:
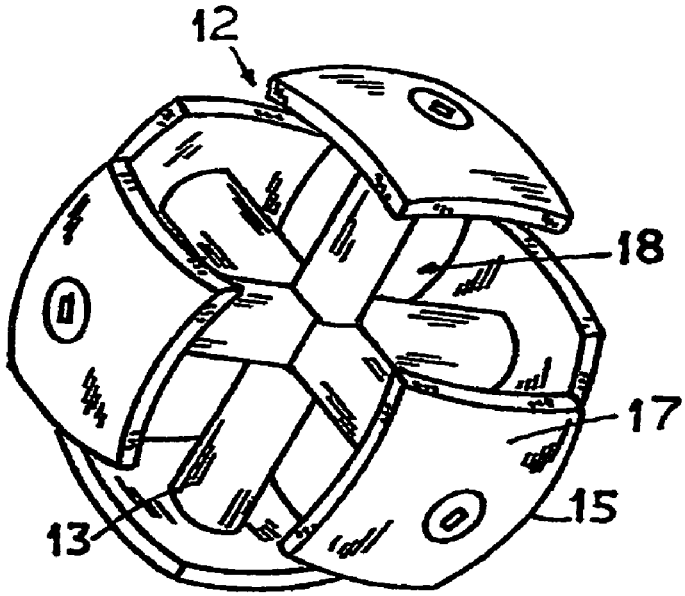
FIG. 3 is a perspective front elevation view of the spherical core of the octave cube relative to which all block pieces may be moved.
Figure 4:
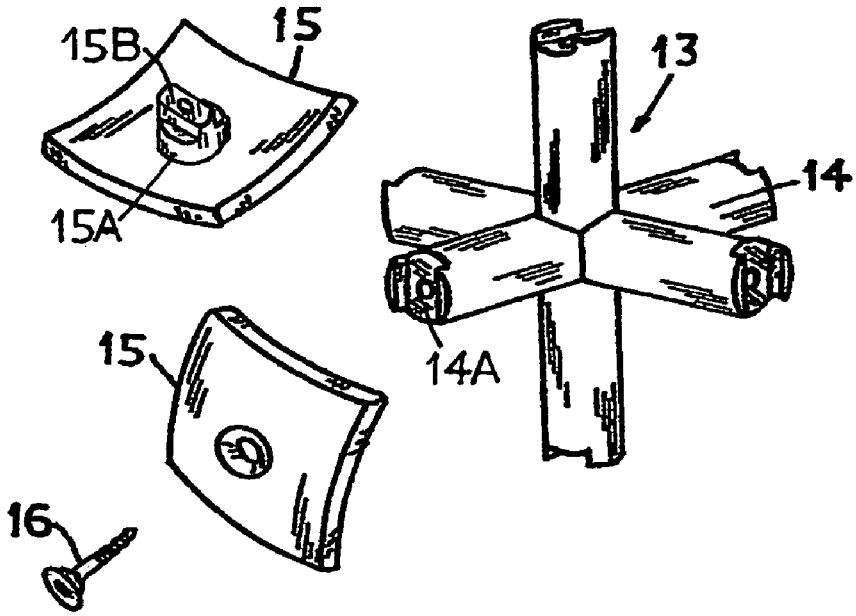
FIG. 4 is an exploded front elevation view of the components of the spherical core.

With reference to the drawings in which like reference numerals designate corresponding parts in the several different view, the octave cube 10 of the present invention has eight block pieces 11 which are movable relative to one another by turning a group of four block pieces 11 relative to the neighboring group of four block pieces as shown in FIG. 2 in turns so as to change the positions of the block pieces relative to one another. Graphic and/or pictorial designs are provided on the surface of the block pieces 11 such that variations of an overall graphic and/or pictorial design may be obtained by changing the positions of the block pieces 11 relative to one another.

The octave cube 10 has a spherical core 12 consisting of a center cross member 13 having six arms 14 extending perpendicular to one another. The arms 14 has a bifurcated end with a channel 14A formed therein. Generally rectangular slider plates 15 are mounted at the end of the six arms 14 such as by screws 16. A mounting post 15A having a generally rectangular portion 15B engages with the channel 14A of the arms 14 to prevent the slider plates 15 from rotating relative to the arms 14. The slider plates 15 have a outer partial spherical surface 17 such that, when they are mounted to the center cross member 13, a spherical core is formed with channel spaces 18 located between the adjacent slider plates 15.

Figure 5:
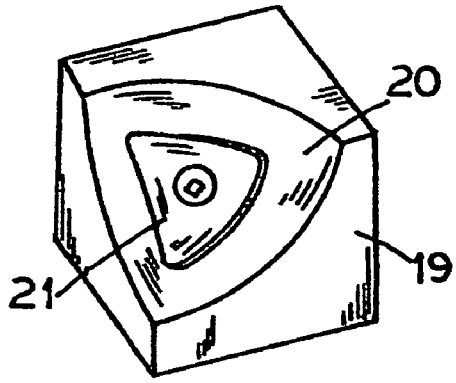
FIG. 5 is a perspective front elevation view of the movable block piece with the retainer plate mounted thereon.
Figure 6:
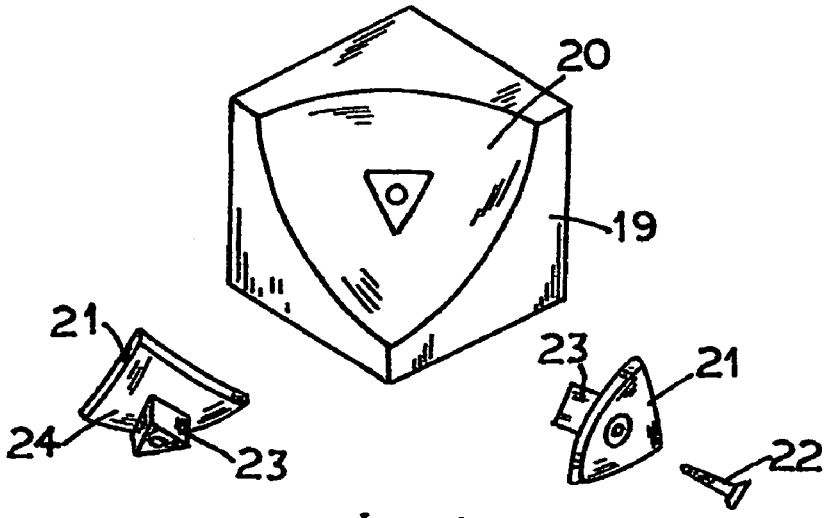
FIG. 6 is an exploded perspective front elevation view showing the components parts of the movable block piece.
Figure 7:
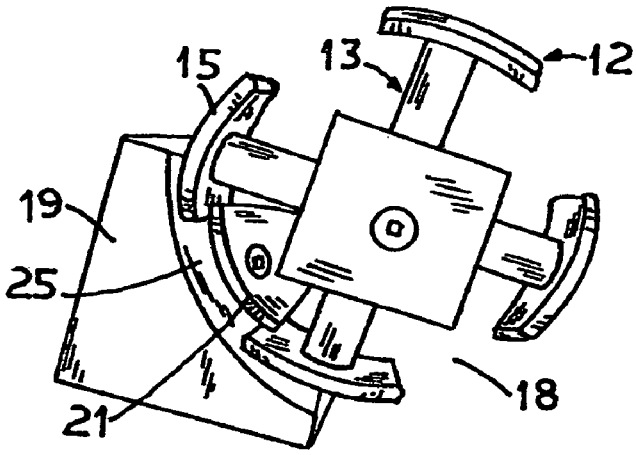
FIG. 7 is a perspective side elevation view showing the mounting of the movable block piece slidably to the core.
Figure 8:
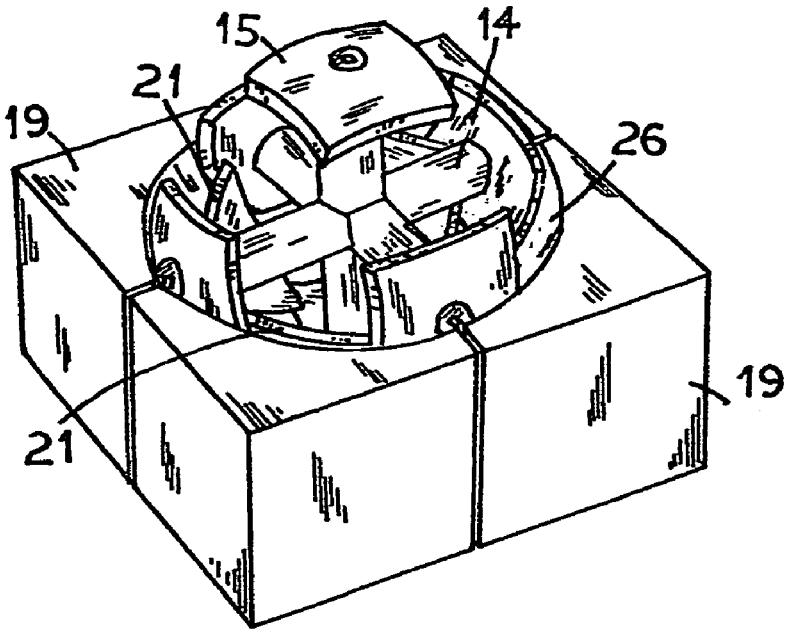
FIG. 8 is a perspective side and top elevation view of the cube with the core located within the semi-spherical hollow formed by the bottom four movable block pieces.

The block pieces consist of seven movable block pieces 19 having a cubic shape with a partial spherical depression 20 formed in one corner therein. A triangular shape retainer plate 21 is mounted such as by a screw 22 at the center of the partial spherical depression 20 as best shown in FIG. 5. The retainer plate 21 has a partial spherical curvature equal to that of the partial spherical depression 20 of the movable block piece 19. The retainer plate 21 has a stand-off post 23 extending rearwards from its rear surface 24, and it maintains the rear surface 24 of the retainer plate 21 to space from the surface of the partial spherical depression 20 of the movable block piece 19 at a distance slightly larger than the thickness of the slider plates 15 of the core 12 to form a partial spherical gap 25. The movable block pieces 19 may be slidably mounted to the core 12 by slidably engaging the retainer plate 21 within the channel 18 of the core 12 such that the slider plate 15 of the core is slidably located within the partial spherical gap 25. All movable block pieces 19 may be slidably mounted to the core 12 one by one in this manner. When the movable block pieces 19 are slidably mounted to the core 12, the partial spherical depression 20 of the block pieces 19 forms a spherical hollow 26 which is larger in diameter than the diameter of the core 12, and the movable block pieces 19 are freely movable slidably relative to the core 12 with their slider plates 15 sliding in the spherical gap 25 between the spherical core 12 and the spherical hollow 26 and the core 12. With this provision, it is not necessary to provide a spring mounting for the slider plates as in the prior art construction for maintaining the movable block pieces 19 from intimately engaged with the core 12. FIG. 8 shows four movable block pieces 19 mounted to the core 12 so that the partial spherical depressing of the block pieces combining with one another to form half of the spherical hollow 26.

Figure 9:
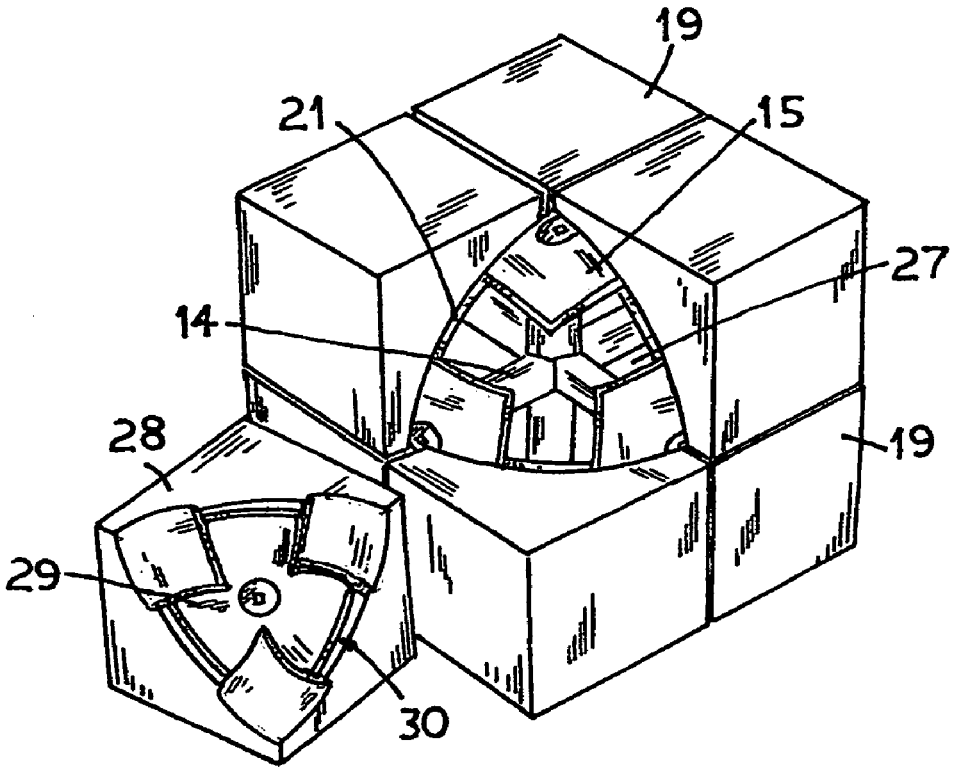
FIG. 9 is a perspective front and top elevation view showing all the movable block pieces mounted to the core and the last block piece to be snap-mounted thereto.

FIG. 9 shows seven movable block pieces 19 have been mounted to the core 12 as described above leaving a last position of the cube 10 empty. The core 12 may be rotated through the exposed opening to position the corners of three slider plates 15 located at the three corners of the exposed opening of the spherical hollow 26 at the last position such that three joining portions of the channel 18 forming a clover leaf space pattern 27 between the slider plates 15 are located adjacent to the last position. The eighth block piece 28 has a mounting plate 29 mounted thereon which is in the form of a clover leaf pattern 30 equal in dimensions and shape to the clover leaf space pattern 27 of the core 12. The eighth block piece 28 can be mounted to the core 12 at the last position by pressing the eighth block piece 28 into the last position such that the clover leaf pattern 30 of the last block piece 28 is snap-fitted into the clover leaf space pattern 27 of the core 12 to mount the eighth block piece 28 fixedly to the latter. After it is mounted to the core 12, the eighth block piece 28 becomes movable together with the core 12 and since the other seven movable block pieces 19 are movable relative to the core 12 and to one another, thus the eighth block piece 28 will become effectively movable together with the core 12 relative to the movable block pieces 19.

It can be understood that without the use of spring loaded slider plates and the provision of a snap-mounted last block piece, the octave cube of the present invention may be easily and quick assembled.

While the present invention has been shown and described in the preferred embodiment thereof, it will be apparent that various modifications can be made therein without departing from the spirit or essential attributes thereof, and it is desired therefore that only such limitations be placed thereon as are imposed by the appended claims.

What is claimed is:

1. An octave cube comprising, a center core including a center cross member having six arms perpendicular to one another and having a square slider plate fixedly mounted at an end of each of said arms, said slider plate having a partial spherical outer surface, and a pattern of space channel being formed between neighboring slider plates, seven movable cubic block pieces a partial spherical depression formed at a corner of each one of said movable cubic block pieces, said depression of said block pieces forming a spherical hollow within said cube, and said spherical hollow having a diameter larger than the diameter of said core, a triangular retainer plate mounted at a center portion of said partial spherical depression of said each one of said movable cubic block pieces, said retainer plate having a curvature equal to said spherical depression and being maintained spaced by a partial spherical space from said depression by a stand-off post located at a rear surface of said retainer plate, said seven movable cubic block pieces being slidably mounted to said core with said slider plate therein slidably engaged with said partial spherical space, an eighth cubic block piece having a partial spherical depression formed at a corner therein, a mating plate of a three-leaf pattern located in said partial spherical depression, said mating plate being engageable with a clover leaf space pattern of said space channel of said center core for mounting said eighth cubic block piece with a snap action to said center core at a remaining position in said space channel after said seven movable cubic block pieces having been mounted to said center core, and said eighth cubic block piece being movable together with said core relative to said movable cubic block pieces.

2. An octave cube according to claim 1 wherein said mating plate and said center core have an equal curvature and said three-leaf pattern of said mating plate is equal in shape and dimensions to said clover leaf space pattern of said space channel of said core exposed in said remaining position of said cube.

3. An octave cube according to claim 2 wherein said slider plates have a thickness equal to said partial spherical space between said retainer plate and said depression of said movable cubic block pieces.

4. An octave cube according to claim 3 including a design pattern provided on outer surfaces of said seven movable cubic block pieces and said eighth cubic block piece.

* * * * *